US005810359A

United States Patent [19]

Wilkins et al.

[11] Patent Number: 5,810,359

[45] Date of Patent: Sep. 22, 1998

[54] BOARD GAME

[75] Inventors: Robert F. Wilkins, Greenfield; David B. Beffa-Negrini, Walpole; David M. Hall, Gilsum, all of N.H.

[73] Assignee: McLellan & McMahon, Inc., Milford, N.H.

[21] Appl. No.: 839,214

[22] Filed: Apr. 22, 1997

Related U.S. Application Data

[62] Division of Ser. No. 521,873, Aug. 31, 1995.

[51] Int. Cl.[6] ..... A63F 3/00

[52] U.S. Cl. ..... 273/256; 273/283

[58] Field of Search ..... 273/242, 243, 273/256, 276, 278, 283, 284, 287

[56] References Cited

U.S. PATENT DOCUMENTS

| | | | |
|---|---|---|---|
| 458,401 | 8/1891 | Manning . | |
| 2,026,082 | 12/1935 | Darrow . | |
| 2,282,128 | 5/1942 | Gubbins . | |
| 2,926,917 | 3/1960 | Kriz . | |
| 3,606,334 | 9/1971 | Pippin . | |
| 3,804,416 | 4/1974 | Jones et al. . | |
| 4,484,749 | 11/1984 | Charney | 273/283 |
| 4,569,527 | 2/1986 | Rosenwinkel et al. | 273/251 |
| 4,585,233 | 4/1986 | Wilson | 273/256 |
| 4,614,344 | 9/1986 | O'Connor | 273/283 |
| 5,255,923 | 10/1993 | Bennett | 273/284 |
| 5,388,836 | 2/1995 | Foti | 273/256 |

FOREIGN PATENT DOCUMENTS

| | | |
|---|---|---|
| 2406775 | 8/1975 | Germany . |
| 694880 | 7/1953 | United Kingdom . |

OTHER PUBLICATIONS

"Stock Exchange" game board attachment and Rules for Stock Exchange instruction sheet, Chessex, 2990 San Pablo Ave., Berkeley, CA 94702 © 1992.

*Primary Examiner*—William E. Stoll
*Attorney, Agent, or Firm*—Wolf, Greenfield & Sacks, P.C.

[57] ABSTRACT

An add-on board game is disclosed which permits transitions between new and existing boards based on random factors. The game includes a variety of new features including travel cards, random penalties and bonuses, and different mechanisms for traveling around the board. The add-on board game may be adapted for use with the MONOPOLY board game.

20 Claims, 12 Drawing Sheets

80

TITLE DEED
BALTIC AVE.
RENT $4.
With 1 House $ 20.
With 2 Houses 60.
With 3 Houses 180.
With 4 Houses 320.
With HOTEL $450.
Mortgage Value $30.
Houses cost $50. each
Hotels, $50. plus 4 houses TITLE DEED
MEDITERRANEAN AVE.
RENT $2.
With 1 House $ 10.
With 2 Houses 30.
With 3 Houses 90.
With 4 Houses 160.
With HOTEL $250.
Mortgage Value $30.
Houses cost $50. each
Hotels, $50. plus 4 houses TITLE DEED
CONNECTICUT AVE.
RENT $8.
With 1 House $ 40.
With 2 Houses 100.
With 3 Houses 300.
With 4 Houses 450.
With HOTEL $600.
Mortgage Value $60.
Houses cost $50. each
Hotels, $50. plus 4 houses TITLE DEED
ORIENTAL AVE.
RENT $6.
With 1 House $ 30.
With 2 Houses 90.
With 3 Houses 270.
With 4 Houses 400.
With HOTEL $550.
Mortgage Value $50.
Houses cost $50. each
Hotels, $50. plus 4 houses TITLE DEED
VERMONT AVE.
RENT $6.
With 1 House $ 30.
With 2 Houses 90.
With 3 Houses 270.
With 4 Houses 400.
With HOTEL $550.
Mortgage Value $50.
Houses cost $50. each
Hotels, $50. plus 4 houses TITLE DEED
ST. CHARLES PLACE
RENT $10.
With 1 House $ 50.
With 2 Houses 150.
With 3 Houses 450.
With 4 Houses 625.
With HOTEL $750.
Mortgage Value $70.
Houses cost $100. each
Hotels, $100. plus 4 houses TITLE DEED
STATES AVE.
RENT $10.
With 1 House $ 50.
With 2 Houses 150.
With 3 Houses 450.
With 4 Houses 625.
With HOTEL $750.
Mortgage Value $70.
Houses cost $100. each
Hotels, $100. plus 4 houses TITLE DEED
VIRGINIA AVE.
RENT $12.
With 1 House $ 60.
With 2 Houses 180.
With 3 Houses 500.
With 4 Houses 700.
With HOTEL $900.
Mortgage Value $80.
Houses cost $100. each
Hotels, $100. plus 4 houses TITLE DEED
ST. JAMES PLACE
RENT $14.
With 1 House $ 70.
With 2 Houses 200.
With 3 Houses 550.
With 4 Houses 750.
With HOTEL $950.
Mortgage Value $90.
Houses cost $100. each
Hotels, $100. plus 4 houses TITLE DEED
TENNESSEE AVE.
RENT $14.
With 1 House $ 70.
With 2 Houses 200.
With 3 Houses 550.
With 4 Houses 750.
With HOTEL $950.
Mortgage Value $90.
Houses cost $100. each
Hotels, $100. plus 4 houses TITLE DEED
NEW YORK AVE.
RENT $16.
With 1 House $ 80.
With 2 Houses 220.
With 3 Houses 600.
With 4 Houses 800.
With HOTEL $1000.
Mortgage Value $100.
Houses cost $100. each
Hotels, $100. plus 4 houses

FIG. 2a

80

TITLE DEED
MARVIN GARDENS

RENT $24.
With 1 House $ 120.
With 2 Houses 360.
With 3 Houses 850.
With 4 Houses 1025.
With HOTEL $1200.
Mortgage Value $140.
Houses cost $150. each
Hotels, $150. plus 4 houses

TITLE DEED
ATLANTIC AVE.

RENT $22.
With 1 House $110.
With 2 Houses 330.
With 3 Houses 800.
With 4 Houses 975.
With HOTEL $1150.
Mortgage Value $130.
Houses cost $150. each
Hotels, $150. plus 4 houses

TITLE DEED
VENTNOR AVE.

RENT $22.
With 1 House $110.
With 2 Houses 330.
With 3 Houses 800.
With 4 Houses 975.
With HOTEL $1150.
Mortgage Value $130.
Houses cost $150. each
Hotels, $150. plus 4 houses

TITLE DEED
ILLINOIS AVE.

RENT $20.
With 1 House $100.
With 2 Houses 300.
With 3 Houses 750.
With 4 Houses 925.
With HOTEL $1100.
Mortgage Value $120.
Houses cost $150. each
Hotels, $150. plus 4 houses

TITLE DEED
INDIANA AVE.

RENT $18.
With 1 House $ 90.
With 2 Houses 250.
With 3 Houses 700.
With 4 Houses 875.
With HOTEL $1050.
Mortgage Value $110.
Houses cost $150. each
Hotels, $150. plus 4 houses

TITLE DEED
KENTUCKY AVE.

RENT $18.
With 1 House $ 90.
With 2 Houses 250.
With 3 Houses 700.
With 4 Houses 875
With HOTEL $1050.
Mortgage Value $110.
Houses cost $150. each
Hotels, $150. plus 4 houses

TITLE DEED
PENNSYLVANIA AVE.

RENT $28.
With 1 House $ 150.
With 2 Houses 450.
With 3 Houses 1000.
With 4 Houses 1200.
With HOTEL $1400.
Mortgage Value $160.
Houses cost $200. each
Hotels, $200. plus 4 houses

TITLE DEED
NO. CAROLINA AVE.

RENT $26.
With 1 House $ 130.
With 2 Houses 390.
With 3 Houses 900.
With 4 Houses 1100.
With HOTEL $1275.
Mortgage Value $150.
Houses cost $200. each
Hotels, $200. plus 4 houses

TITLE DEED
PACIFIC AVE.

RENT $26.
With 1 House $ 130.
With 2 Houses 390.
With 3 Houses 900.
With 4 Houses 1100.
With HOTEL $1275.
Mortgage Value $150.
Houses cost $200. each
Hotels, $200. plus 4 houses

TITLE DEED
PARK PLACE

RENT $35.
With 1 House $ 175.
With 2 Houses 500.
With 3 Houses 1100.
With 4 Houses 1300.
With HOTEL $1500.
Mortgage Value $175.
Houses cost $200. each
Hotels, $200. plus 4 houses

TITLE DEED
BOARDWALK

RENT $50.
With 1 House $ 200.
With 2 Houses 600.
With 3 Houses 1400.
With 4 Houses 1700.
With HOTEL $2000.
Mortgage Value $200.
Houses cost $200. each
Hotels, $200. plus 4 houses

FIG. 2b

82

TITLE DEED
LOMBARD ST.

RENT $17.
With 1 House $ 85.
With 2 Houses 240.
With 3 Houses 670.
With 4 Houses 840.
With HOTEL $1025.

Mortgage Value $105.
Houses Cost $100. each
Hotels, $100. plus 4 houses

TITLE DEED
MARKET ST.

RENT $17.
With 1 House $ 85.
With 2 Houses 240.
With 3 Houses 670.
With 4 Houses 840.
With HOTEL $1025.

Mortgage Value $105.
Houses Cost $100. each
Hotels, $100. plus 4 houses

TITLE DEED
FISHERMAN S WHARF

RENT $21.
With 1 House $105.
With 2 Houses 320.
With 3 Houses 780.
With 4 Houses 950.
With HOTEL $1125.

Mortgage Value $125.
Houses Cost $100. each
Hotels, $100. plus 4 houses

TITLE DEED
BISCAYNE AVE.

RENT $11.
With 1 House $ 55.
With 2 Houses 160.
With 3 Houses 475.
With 4 Houses 650.
With HOTEL $800.

Mortgage Value $75.
Houses Cost $50. each
Hotels, $50. plus 4 houses

TITLE DEED
FLORIDA AVE.

RENT $9.
With 1 House $ 45.
With 2 Houses 120.
With 3 Houses 350.
With 4 Houses 500.
With HOTEL $700.

Mortgage Value $65.
Houses Cost $50. each
Hotels, $50. plus 4 houses

TITLE DEED
MIAMI AVE.

RENT $9.
With 1 House $ 45.
With 2 Houses 120.
With 3 Houses 350.
With 4 Houses 500.
With HOTEL $700.

Mortgage Value $65.
Houses Cost $50. each
Hotels, $50. plus 4 houses

FIG. 2c

82

TITLE DEED
FIFTH AVE.

RENT $60.
With 1 House $ 220.
With 2 Houses 650.
With 3 Houses 1500.
With 4 Houses 1800.
With HOTEL $2100.

Mortgage Value $215.
Houses Cost $300. each
Hotels, $300. plus 4 houses

TITLE DEED
WALL ST.

RENT $80.
With 1 House $ 300.
With 2 Houses 800.
With 3 Houses 1800.
With 4 Houses 2200.
With HOTEL $2700.

Mortgage Value $250.
Houses Cost $300. each
Hotels, $300. plus 4 houses

TITLE DEED
MADISON AVE

RENT $60.
With 1 House $ 220.
With 2 Houses 650.
With 3 Houses 1500.
With 4 Houses 1800.
With HOTEL $2100.

Mortgage Value $215.
Houses Cost $300. each
Hotels, $300. plus 4 houses

TITLE DEED
BEACON ST.

RENT $30.
With 1 House $ 160.
With 2 Houses 470.
With 3 Houses 1050.
With 4 Houses 1250.
With HOTEL $1500.

Mortgage Value $165.
Houses Cost $200. each
Hotels, $200. plus 4 houses

TITLE DEED
BOYLSTON ST.

RENT $40.
With 1 House $ 185.
With 2 Houses 550.
With 3 Houses 1200.
With 4 Houses 1500.
With HOTEL $1700.

Mortgage Value $190.
Houses Cost $200. each
Hotels, $200. plus 4 houses

TITLE DEED
COMMONWEALTH AVE.

RENT $30.
With 1 House $ 160.
With 2 Houses 470.
With 3 Houses 1050.
With 4 Houses 1250.
With HOTEL $1500.

Mortgage Value $165.
Houses Cost $200. each
Hotels, $200. plus 4 houses

FIG. 2d

85

PENNSYLVANIA R.R.

| | |
|---|---|
| Rent | $25. |
| If 2 R.R.'s are owned | 50. |
| If 3 " " " | 100. |
| If 4 " " " | 200. |
| Mortgage Value | $100. |

B. & O. RAILROAD

| | |
|---|---|
| Rent | $25. |
| If 2 R.R.'s are owned | 50. |
| If 3 " " " | 100. |
| If 4 " " " | 200. |
| Mortgage Value | $100. |

READING RAILROAD

| | |
|---|---|
| Rent | $25. |
| If 2 R.R.'s are owned | 50. |
| If 3 " " " | 100. |
| If 4 " " " | 200. |
| Mortgage Value | $100. |

SHORT LINE R.R.

| | |
|---|---|
| Rent | $25. |
| If 2 R.R.'s are owned | 50. |
| If 3 " " " | 100. |
| If 4 " " " | 200. |
| Mortgage Value | $100. |

90

ELECTRIC COMPANY

If one "Utility" is owned rent is 4 times amount shown on dice.

If both "Utilities" are owned rent is 10 times amount shown on dice.

Mortgage Value $75.

WATER WORKS

If one "Utility" is owned rent is 4 times amount shown on dice.

If both "Utilities" are owned rent is 10 times amount shown on dice.

Mortgage Value $75.

FIG. 3a

BOARD GAME

This application is a division of application Ser. No. 08/521,873, filed Aug. 31, 1995 (pending).

TECHNICAL FIELD

This application relates to the field of games for amusement and entertainment, and more particularly, to a new and improved board game and method of play that is capable of being used in conjunction with existing board games.

BACKGROUND OF THE INVENTION

Board games have been a popular source of entertainment for people for a number of years. A number of games exist, including the following.

U.S. Pat. No. 3,804,416 to Jones et al. discloses a game having two playing boards, one mounted on top of the other. Each player has four playing pieces. The goal of the game is to move all four playing pieces from a start to an end position. One player's piece can land on another player's piece and send it back to the beginning. The top board is rotated according to a roll of the die. Whenever a game piece lands on an indicated "socket," that piece is automatically moved to the socket above or below the space on which the piece landed. The game also has a feature where a piece that lands on certain designated sockets can be moved to the center of the board. A player must roll a specific number to move out of the center of the board, but when that number is rolled the player can move to any of the transition sockets on either game board. Optionally, a player making a move that ends on an indicated socket can move diagonally when transitioning between boards.

U.S. Pat. No. 3,606,334 to Pippin discloses a game that includes rotatable discs. The goal of the game is to move pieces from a start position to an end position. The paths on the game board, however, include paths on discs. Based on the spin of a pinwheel, the players can rotate these discs during play.

U.S. Pat. No. 4,484,749 to Charney discloses a game board that comes in several different pieces. Those pieces can be assembled in a variety of different combinations. Each piece corresponds to a "region" such as Paris or London. Each piece includes a number of business locations, defining paths on the board piece. Play in this game proceeds as follows. Each player has an initial amount of money. In addition, there are a number of "business coupons" associated with locations on the boards. The business coupons can be acquired by taking one from an opposing player when the player lands on a board location already occupied by the opposing player, receiving one free when landing on a special chamber of commerce location, or purchasing one when landing on a special newsstand location. When a player lands on a business location, he can exchange one or more business coupons corresponding to that location for money. The purpose of the game is to amass a fortune in order to, at the end of the game, purchase the business locations on the board. The board includes a number of board locations corresponding to "time." When a time location is landed on, a new time card is drawn. This indicates the advancing of time under the game. Drawing a time card changes the cost of purchasing new business coupons (e.g., at a newsstand location), the current value of tax assessed (e.g., if the player lands on a bureau of taxation location), and a limo fare (as explained below). Other features disclosed in the specification include:

(a) A travel agency location on the board. When landing on a travel agency, a player may risk a business coupon against a certain amount of money held by the Bank. When this is done, the player draws a "postcard" from a deck. If the postcard happens to match the region of the board on which the player's game piece is located, the player wins the money. Otherwise, the player must give up the business coupon.

(b) The board includes hotel locations. When a hotel is landed on, the player may pay a limousine fare. After paying the fare, the player can move his game piece to any other location on the board.

(c) A player can choose among alternative routes in order to enter different regions on the board.

(d) The individual pieces of the assembled board can be flipped, to reveal new regions, during play.

British Patent 694,880 to Anglo-Scottish Pictures Limited discloses a game board that has a number of pieces. There is a main board that defines a number of incomplete paths. The board is filled in with small reversible boards (i.e., boards that have paths on both sides) that fit into the main board. When a player is positioned to enter a small reversible board, the player rolls a die—the small reversible board is then rotated or flipped so that the small board is positioned such that the player will enter the path on the small board indicated by the die roll. Much of the game path (i.e., on the side of the small board that is facing down) is out of sight at any one moment during play of the game. The game includes a feature for moving the small boards, and changing the direction in which a game piece is moving, based on rolls of dice. For example, if a six and an odd number is rolled, a player may reverse the direction of his game piece on the board. If a player rolls a double six, the player can change the paths on the board (by moving the small reversible boards). If the player rolls a double two or a double four, all of the players may be forced to reverse direction.

U.S. Pat. No. 2,026,082 to Darrow discloses the board game known as Monopoly, which is described in greater detail below.

U.S. Pat. No. 5,388,836 to Foti discloses a board game where more than one board is used, each board representing a different geographical area. Play within each area is similar to play for Monopoly. Each geographic location may use a different currency and the exchange rates may change during play. Transitions between boards are mandatory and made when landing on a deportation board location.

U.S. Pat. No. 4,585,233 to Wilson discloses an add-on board for a game, and is specifically applied to Monopoly. The patent discloses an add-on board for Monopoly where the new board locations are positioned around the exterior of an existing Monopoly board. The add-on board has a recess in its center where the existing Monopoly board is placed—such that the add-on board locations and the existing Monopoly board locations are flush. Entry to and exit from the add-on board is done automatically, i.e., a player who passes the indicated board position will always transition from one board to the other. This patent also discloses addition of board locations for bridges and airlines.

Games such as those described above offer varying levels of skill, elements of chance and theme. For example, some games are directed to positioning pieces on a game board, where pieces are moved based on a random factor such as a roll of dice. Other games, such as chess, involve no random element and are based only on skill. In addition, some games have no theme and involve only the positioning of pieces on a game board. Other games have a theme such as real estate transactions (for example, Monopoly). Finally, games have varying levels of complexity both in the rules for the game and for strategic decisions made during the course of play.

It is a goal, therefore, to attempt to find a mix of the random elements, strategy, theme and complexity that enhances people's enjoyment of the game and retains their interest over time.

People playing games often wish to play familiar games in order to avoid having to learn new and difficult rules. People also become bored, however, with playing the same game over and over again. One solution to this problem is to develop an add-on board for existing games.

U.S. Pat. No. 4,585,233 to Wilson discloses an add-on board game for the game of Monopoly. The add-on board is shaped to fit around the perimeter of the existing Monopoly board game—thus increasing the size of the overall playing surface. In addition, transitions from the existing board to the add-on board and transitions back are mandatory.

Accordingly, people desire a new and improved game that offers new features which are not found in the prior art and that provide a mix of skill, chance and theme that increase people's enjoyment in their leisure time.

SUMMARY OF THE INVENTION

According to the present invention an add-on board may be provided for an existing game board. The add-on board has a plurality of new board locations and a mechanism for indicating how to transition between boards.

According to the invention, elements of chance may be introduced into the circumstances where a player transitions between boards, thereby increasing variation and significantly altering strategy in the game during play.

The add-on board may be shaped to fit within the existing game board. In this configuration, the overall perimeter of the two boards is the same as the perimeter of the existing board, resulting in the advantages of greater familiarity and comfort with the game playing surface and avoiding a larger overall playing area which may not fit on the surface or table on which the game is being played or may be difficult for players to reach across.

The add-on board may have a number of novel and exciting new features, which are suitable for use in an add-on board game or for use in any board game. The add-on board may include a move backwards location where a player moves in the opposite direction on the player's next turn. This creates fun and excitement because a player may be forced to traverse the same section of the board more than one time on succeeding turns. In addition, if the move backwards board location is located near a point where a player may transition from one board to the other, a player landing on the move backwards board location may remain in suspense as to whether the player will be forced to transition back to a different board after transitioning onto the board. Alternatively, the move backwards location may cause the entire add-on board to change orientation against the existing board, thereby altering the game playing surface during play.

The add-on board may have a board location that becomes a part of a common group with board locations on the existing board. This subtly alters play with the existing game by requiring a player to traverse both the add-on board and the existing board to take advantage of having landed on all of the members of the common group.

The add-on board may include a subway board location where a player landing on the subway board location may move to any other location.

The add-on board may include a double trouble board location where a player landing on that board location receives a bonus and the other players receive a corresponding penalty based on a random factor. This adds excitement because of the ability to both advance the player's position while damaging each other player's position when this board location is landed on.

The add-on board may include a refund board location where the player landing on the refund board location receives a bonus that is based on penalties assessed during the game. This increases enjoyment in the game by slowly building a pot of money from which a player landing on the suitable board location can benefit.

The add-on board may also include travel cards that provide instructions on where to move pieces. Once acquired, these travel cards may be used in place of a random element used to determine the number of board locations traversed during a move. This adds an element of strategy to the game by requiring a player to choose whether to play a travel card to get to a known location or to "roll the dice" and see where the player lands.

The add-on board may also include triple play cards and a triple play board location. When a triple play board location is landed on, the player may determine a random number and match that number against the triple play card. Bonuses are awarded based on the outcome of the random number determination and the content of the triple play card. This adds to the excitement of the game. Players may accumulate triple play cards during play, making the sum of bonuses awarded after landing on the triple play board location greater later in the game. Players may also trade or sell triple play cards, adding a further element of strategy to the game.

The add-on board game may also include a movable airplane, where a player landing on any board location where the airplane is located may move the player's game piece and the airplane to another board location. This increases variation in play of the game and provides a unique way of both transitioning between boards and moving around an existing board. The add-on board game may also include a movable bridge as a way of designating where a player transitions from an existing board to the add-on board, and/or vice versa.

As can be seen from the above, when new and additional rules are used with an add-on board and an existing board game, the new combined game retains the advantage of familiarity with the existing board game while also renewing interest in the board game by offering variations on the rules adapted for use with the add-on board game.

In alternative embodiments, the features are adapted for use with a Monopoly game board as the existing board game.

Other objects of the present invention, as well as particular features and the advantages thereof, will be apparent from the following description and the drawings.

BRIEF DESCRIPTION OF DRAWINGS

FIG. 2*a–b* illustrates Monopoly Title Deed cards 80;

FIG. 2*c–d* illustrates additional Title Deed cards 82;

FIG. 3*a* illustrates Monopoly railroad Title Deed cards 85 and utilities Title Deed cards 90;

DETAILED DESCRIPTION OF THE PREFERRED EMBODIMENTS

While the description of the preferred embodiment relates to an add-on board for the game of Monopoly, it should be understood that the invention relates to add-on board games generally, the addition of new features to existing board games, methods of play, and any other features described in the claims. The term "board" as used herein includes not just a firm board as in the preferred embodiment, which may or may not be foldable along an axis, but also any equivalent structure such as a surface made of another material (e.g., paper, cloth or plastic) or an electronically or computer implemented board.

Figure 1:
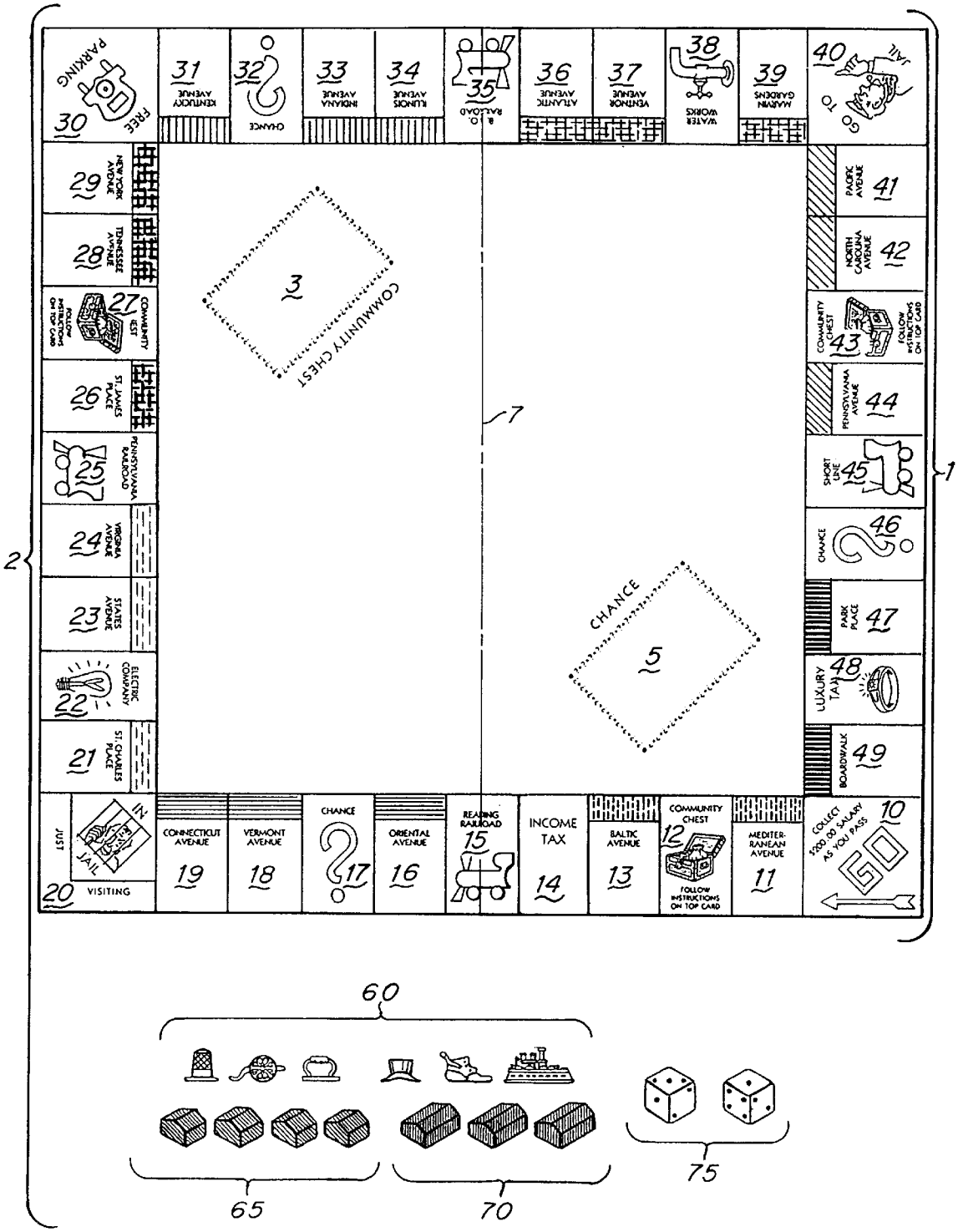
FIG. 1 (PRIOR ART)
FIG. 1 illustrates certain starting materials for Monopoly 2, including the board for Monopoly 1, game pieces 60, houses 65, hotels 70 and dice 75.

FIG. 1 illustrates the board game of Monopoly 1. The Monopoly board 1 is preferably made of a firm material and is foldable along an axis. One version of Monopoly is described in U.S. Pat. No. 2,026,082 to Darrow, which is fully incorporated herein by reference. A description of the current rules for Monopoly follows.

The Monopoly game board 1 includes a plurality of board locations 10–49. The board locations 10–49 are arranged around the periphery of the board 1. At the interior of the board 1, there are markings for a location 3 for Community Chest cards 96 and for a location S for Chance cards 94. During play, the Community Chest cards 96 and Chance cards 94 are positioned in the marked locations 3, 5.

Each board location 10–49 is marked with indicia that selectively indicate the function of the board location. Board locations 11, 13, 15, 16, 18, 19, 21–26, 28, 29, 31, 33–39, 41, 42, 44, 45, 47, 49 are property board locations. Certain of the board locations have indicia indicating that the locations are of a common group, such as a color unique to that common group. For example, board locations 11 and 13 define a common group by having a marking unique (e.g., purple) to the common group at the top of each of board location 11 and 13. Similarly, the railroads 15, 25, 35, 45 form a common group and the utilities 22 and 38 form a common group. Other common groups are: 16, 18, 19; 21, 23, 24; 26, 28, 29; 31, 33, 34; 36, 37, 39; 41, 42, 44; and 47, 49.

FIG. 2*a–b* shows Title Deed cards 80 for use with Monopoly, although variations on these and all of the other cards described in this specification are, of course, possible. A unique one of the Title Deed cards 80 is provided for each property board location 11, 13, 16, 18, 19, 21, 23, 24, 26, 28, 29, 31, 33, 34, 36, 37, 39, 41, 42, 44, 47, 49. Each of the Title Deed cards 80 includes indicia identifying which board location corresponds to the Title Deed card, a price for the board location, dollar figures for rent (including figures for rent if all property board 35 locations of the same common group are owned, and figures if houses or hotels are located on the board location, as described below), the cost of placing houses and hotels on the property board location and a mortgage value. The Title Deed card may also bear indicia designating a common group to which the correspondiong board location belongs, such as a purple color at the top of the Baltic Avenue 13 Title Deed card.

FIG. 3*a* illustrates Title Deed cards for railroad board locations 15, 25, 35, 45. A unique one of the Title Deed cards 85 is provided for each railroad board location 15, 25, 35, 45. Each of these Title Deed cards 85 include indicia identifying which board location corresponds to the Title Deed card, a price for the board location, rent figures that vary depending on the number of railroads owned and a mortgage value.

Figure 3B:
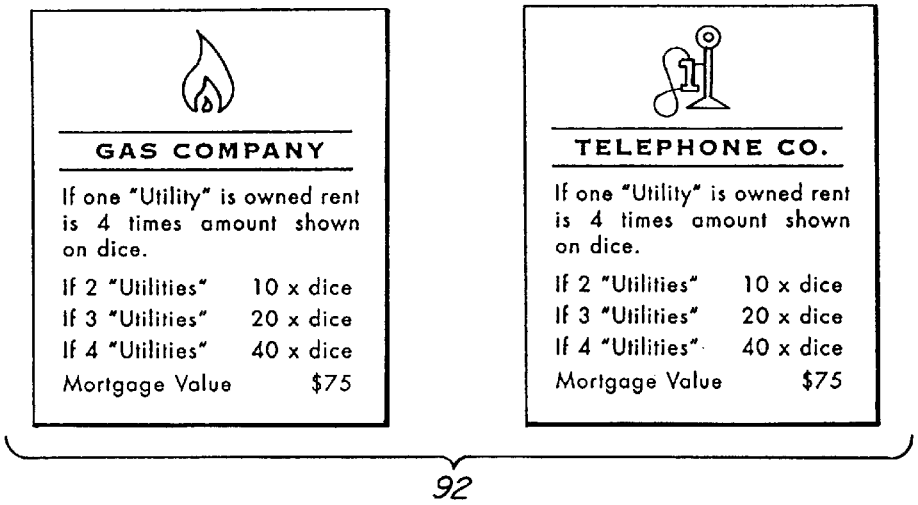
FIG. 3*b* illustrates additional utilities Title Deed cards 92.

FIG. 3*b* illustrates Title Deed cards 90 for utilities board locations 22, 38. A unique one of the Title Deed cards 90 is also provided for each utility board location 22, 38. These Title Deed cards 90 include indicia identifying which board location corresponds to the Title Deed card, a price for the board location, rent figures that vary depending on the number of utilities owned and a roll of the dice 75, and a mortgage value.

The Monopoly game is played as follows. The object of the game is to acquire the most money 98 through buying, renting and selling property board locations. Optionally, the object of the game is to drive the other players out of money 98, or "Bankrupt."

Each player begins by choosing one of the game pieces 60 to represent the player while traveling around the board 1. Each player begins with $1,500 of money 98 provided with the game and held during play by the Bank (until paid to players).

A player is selected to go first and the players alternate turns. When play is started, each player begins his or her first turn on a board location marked "GO" 10 by placing the player's game piece 60 on that board location 10.

For each turn, the player taking the turn throws the dice 75 and moves the player's game piece 60, in the direction of the arrow on the GO board location 10 (clockwise), the number of board locations 10–49 indicated by the dice 75. After a turn is completed, the next player takes a turn. The game pieces 60 remain on the board locations occupied at the end of a turn and proceed from that point on the player's next turn. Two or more game pieces 60 may rest on the same board location 10–49 at the same time.

According to the ending board location for a turn, (the board location that is "landed" on) a player may be entitled to buy property board locations—or obliged to pay rent, pay taxes, draw a Chance 94 or Community Chest 96 card, "Go to Jail", etc.

If a player rolls doubles (both dice 75 having the same number), a player moves his or her game piece as usual and completes that turn, but after that turn, the player rolls again and takes an additional turn. If doubles are thrown three times in a row, a player must move his or her game piece 60 to the In Jail board location 20.

Each time a player's game piece 60 lands on or passes over the GO board location 10, whether by throwing the dice 75 or drawing a card, the player receives a $200 salary from the Bank (payment to players may be referred to as a bonus). The $200 is paid only once each time around the board 1. However, if a player passing GO 10 on the throw of the dice 75 lands two board locations beyond it on Community Chest 43, or seven board locations beyond it on Chance 46, and draws an "Advance to GO" card, the player collects $200 for passing GO 10 the first time and another $200 for reaching it the second time by instructions on the card.

Whenever a player lands on a property board location not owned by another player, the player may buy that board location at the price indicated on the Title Deed. The player pays the Bank for the property board location and receives the corresponding one of the Title Deed cards 80, 85, 90 from the Bank.

If the player does not wish to buy that property board location, it is auctioned. The buyer pays the amount of the bid in cash 98 to the Bank and receives the Title Deed card 80, 85, 90 for that board location from the Bank. Any player, including the one who declined the option to buy the board location at the printed price, may bid. Bidding may start at any price.

When a player lands on a property board location owned by another player, the owner collects rent from the player in accordance with the list printed on its Title Deed card 80, 85, 90. If the property board location is mortgaged, however, no rent is paid. Payments that a player is required to make may be referred to generally as a penalty.

If an owner owns all the property board locations in a common group, double rent is paid for unimproved board locations (i.e., board locations that do not have houses 65 or hotels 70 on them) in that common group or, in the case of railroads and utilities, per the instructions on the Title Deed card 85, 90. This rule applies to unmortgaged property board locations even if another property board location in that common group is mortgaged. If there are houses 65 or hotels 70 on the board location, the owner collects rent from the player in accordance with the list printed on the board locations Title Deed card 80. No rent is collected if the owner fails to ask for the rent before the next player throws the dice 75 (or alternatively, the player after the next player).

Figure 4:
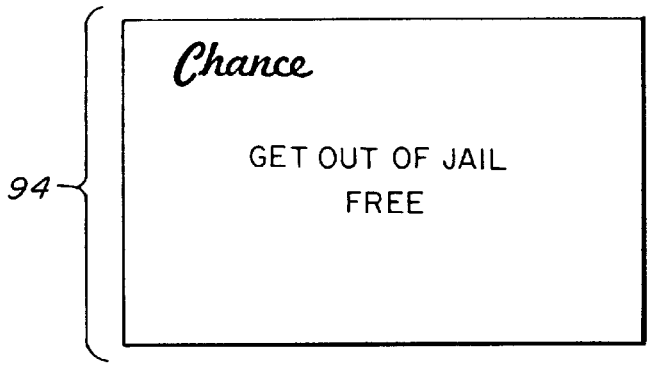
FIG. 4 illustrates a Chance card 94.

FIG. 4 illustrates a Chance card 94. FIG. S illustrates a Community Chest card 96. Each card may contain a different instruction. The instructions for the Monopoly Chance and Community Chest cards appear in Table 1.

TABLE 1

Chance 94 and Community Chest 96 cards

| | CHANCE CARDS | COMMUNITY CHEST CARDS |
|---|---|---|
| 1 | Pay Poor Tax Of $15 | Grand Opera Opening COLLECT $50 FROM EVERY PLAYER FOR OPENING NIGHT SEATS |
| 2 | YOUR BUILDING AND LOAN MATURES COLLECT $150 | YOU INHERIT $100 |
| 3 | BANK PAYS YOU DIVIDEND OF $50 | FROM SALE OF STOCK YOU GET $45 |
| 4 | ADVANCE TOKEN TO NEAREST UTILITY. IF UNOWNED you may buy it from bank. IF OWNED, throw dice and pay owner a total of ten times the amount thrown. | YOU HAVE WON SECOND PRIZE IN A BEAUTY CONTEST COLLECT $10 |
| 5 | TAKE A RIDE ON THE READING IF YOU PASS GO COLLECT $200 | ADVANCE TO GO (COLLECT $200) |
| 6 | TAKE A WALK ON THE BOARD WALK ADVANCE TOKEN TO BOARD WALK | YOU ARE ASSESSED FOR STREET REPAIRS $40 PER HOUSE $115 PER HOTEL |
| 7 | GO DIRECTLY TO JAIL DO NOT PASS GO, DO NOT COLLECT $200 | BANK ERROR IN YOUR FAVOR COLLECT $200 |
| 8 | ADVANCE TO ILLINOIS AVENUE | RECEIVE FOR SERVICES $25 |
| 9 | ADVANCE TO GO (COLLECT $200) | GO TO JAIL GO DIRECTLY TO JAIL DO NOT PASS GO DO NOT COLLECT $200 |
| 10 | ADVANCE TO ST. CHARLES PLACE IF YOU PASS GO, COLLECT $200 | PAY HOSPITAL $100 |
| 11 | Advance token to the nearest Railroad and pay owner Twice the Rental to which he is otherwise entitled. If Railroad is unowned, you may buy it from the Bank. | income tax REFUND COLLECT $20 |
| 12 | Advance token to the nearest Railroad and pay owner Twice the Rental to which he is otherwise entitled. If Railroad is unowned, you may buy it from the Bank. | PAY SCHOOL TAX OF $150 |
| 13 | You Have Been ELECTED CHAIRMAN OF THE BOARD PAY EACH PLAYER $50 | LIFE INSURANCE MATURES COLLECT $100 |
| 14 | THIS CARD MAY BE KEPT UNTIL NEEDED OR SOLD GET OUT OF JAIL FREE | XMAS FUND MATURES COLLECT $100 |
| 15 | Make General Repairs On All Your Property FOR EACH HOUSE PAY $25 FOR EACH HOTEL $100 | GBT OUT OF JAIL, FREE THIS CARD MAY BE KEPT UNTIL NEEDED OR SOLD |
| 16 | GO BACK 3 SPACES | DOCTOR'S FEE PAY $50 |

Whenever a player lands on a Chance 17, 32, 46 or Community Chest 12, 27, 43 board location, the player takes the top card from the deck indicated, follows the instructions and returns the card face down to the bottom of the deck. A "Get Out of Jail Free" card, however, is held until used and then returned to the bottom of the deck. If the player who draws it does not wish to use it, the player may sell it, at any time, to another player at an agreed price.

If a player lands on the income tax board location 14, the player has the option of paying $300 (in the patented version, $200 in versions of Monopoly sold today), or paying 10% of the player's total worth, to the Bank. A player's total worth is the sum of all the cash 98 that the player has, printed prices of mortgaged and unmortgaged property board locations and the cost price of all houses 65 and hotels 70 owned by the player. The player must decide which option to take before adding up the player's total worth.

A player is sent to the Jail board location 20 either when the player's game piece lands on the Go to Jail board location 40; after drawing a Chance 94 or Community Chest 96 card marked "Go to Jail"; or after rolling doubles three time in a row. When sent to Jail, the player does not collect $200 for passing the GO board location 10, and must move directly into Jail.

If the Jail board location 20 is landed on during regular play, the player is "Just Visiting," incurs no penalty, and continues from that location 20 on the player's next turn.

When a player has been sent to the Jail Board location 20, the player gets out of the Jail Board location 20 by throwing doubles on any of the next three turns (in which case the player takes this turn but does not take another turn even though the player threw doubles); using a Chance 94 or Community Chest 96 card marked "Get Out of Jail Free"; or paying a penalty of $50 to the Bank before rolling the dice on either of the player's next two turns. If the player does not roll doubles by the third try, the player pays a $50 penalty to the Bank. The player then immediately moves forward the number of board locations 10–49 shown by the roll. Even though in Jail, a player may buy and sell property board locations, buy and sell houses 65 and hotels 70 and collect rents.

A player landing on the Free Parking board location 30 takes no other action.

When a player owns all the property board locations in a common group (except for railroads 15, 25, 35, 45 and utilities 22, 38), the player may buy houses 65 from the Bank and place them on the board locations. A player may not place an additional house 65 on a board location in a common group unless each of the other board locations in the common group have at least as many houses 65. The price for each house 65 is shown on the Title Deed card 80 for the board location on which the player places the house 65. When a player has four houses 65 on each property board location of a common group, the player may buy a hotel 70 and place it on any board location of the common group. The player returns the four houses 65 from that property board location and pays the price for the hotel 70 as shown on the Title Deed card 80. Only one hotel 70 may be placed on any board location.

When there are no more houses 65, players wishing to build must wait for some player to return or sell houses to the Bank. If there are a limited number of houses 65 and hotels 70 available and two or more players wish to buy the remaining houses 65 or hotels 70, the houses 65 or hotels 70 are auctioned by the Bank.

Board locations may be sold to any player as a private transaction for any amount. No property board location can be sold, however, to another player if a house 65 or hotel 70 is standing on any property board locations of that common group. Any such houses or hotels must be sold back to the Bank before the owner can sell any property board location of that common group.

Houses 65 and hotels 70 may be sold back to the Bank at any time for one-half the price paid for them.

All houses 65 on property board locations in one common group must be sold one by one, evenly, in reverse of the manner in which they were placed on the board locations.

Board locations without houses 65 or hotels 70 can be mortgaged to the Bank at any time. (If there are houses or hotels on the board locations, they must be sold back prior to mortgaging). The mortgage is printed on each of the Title Deed cards 80, 85, 90.

In order to lift a mortgage, the owner must pay the amount of the mortgage plus 10%. When all the property board locations of a common group are no longer mortgaged, the owner may begin to buy houses 65 (at full price).

The player who mortgages a property board location retains possession of it. The owner may sell the mortgaged property board location to another player at any agreed price (subject to the mortgage). If the mortgage is not lifted at once, the purchaser must pay the Bank 10% interest when buying the property board location and 10% interest (plus the price of the mortgage) if the mortgage is lifted.

A player is "Bankrupt" if the player owes more than the player can pay either to another player or to the Bank. If the debt is to another player, the player must turn over to that player all that the player has of value and retire from the game. The Bankrupt player returns any houses 65 or hotels 70 owned by the player to the Bank in exchange for one-half of the money paid for them, which is then given to the creditor. Mortgaged property board locations are also turned over to the creditor, but the new owner must at once pay 10% interest on the mortgage. If the mortgage is not lifted at once, the purchaser must pay the Bank 10% interest when receiving the property board location and 10% interest (plus the price of the mortgage) if and when the mortgage is lifted.

If the player owes the Bank (and not another player) on Bankruptcy, the player must turn over all board locations, houses and hotels to the Bank. The Bank then sells by auction all board locations received (but not the houses or hotels). A Bankrupt player stops playing. The last player left in the game wins.

Money 98 can be loaned to a player only through mortgaging board locations to the Bank—players may not borrow money from other players.

To shorten the game, players may be given or sold Title Deed cards 80, 85, 90 to a fixed number of board locations before play begins. Hotels 70 may be sold after building three houses 65 rather than four. In addition, the ending conditions may be changed. Thus, the game may be ended after one or two Bankruptcies or after a fixed period of time (and the player with the greatest total worth wins).

It should be understood that a number of variations on the above rules can be made without materially departing from what is referred to herein as a "Monopoly" board game. Similarly, names and appearance of board locations (such as naming board locations for another country or for locations within a city), the forms of game pieces, and the content of cards can be changed without departing from what is referred to herein as a Monopoly board game.

Players of Monopoly are furnished with two dice 75, game pieces 60, 32 houses 65 and 12 hotels 70. Players are also furnished with sixteen Community Chest cards 96 and sixteen Chance cards 94, as described in Table 1.

Play in connection with the add-on board of the present invention may now be described. In the preferred embodiment of the present invention, the additional equipment includes an add-on board 150, one extra die 75, eight additional Chance cards 94, eight additional Community Chest cards 96, seventeen additional houses 65, 7 additional hotels 70, 14 additional Title Deeds (with selective indicia corresponding to board locations 161—163, 165, 167, 168, 170, 171, 173, 175, 177, 179, 180, 183), twenty-four travel cards 200, and fifty triple play cards 220.

Figure 7:
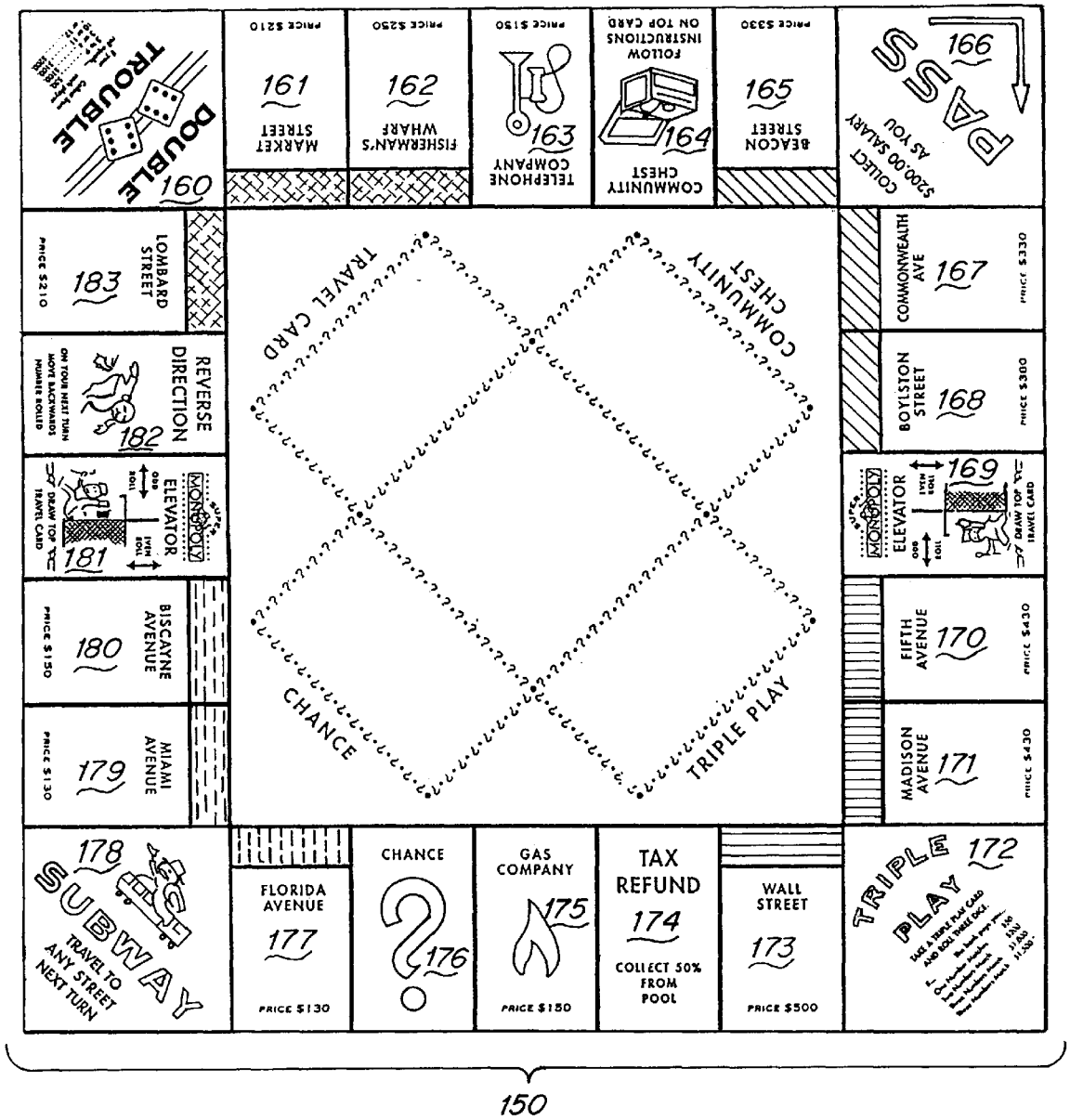
FIG. 7 illustrates an add-on board for Monopoly 150.

FIG. 7 illustrates an add-on board 150 in accordance with the preferred embodiment of the present invention. It should be understood that a variety of different marking, illustrations and shapes for the add-on board are possible. The add-on board may designed to include illustrations that are common to the original board game, such as incorporating logos or figures found on the original board. In the preferred embodiment, the add-on board 150 fits within the perimeter of the Monopoly board 1 and, in the most preferred embodiment, the perimeter of the add-on board fits within the designations for board locations 10–49 of the Monopoly board 1. The add-on board 150 may include indicia for marking where the Chance 94, Community Chest 96, travel 200, and triple play 220, cards are stored during play.

PIG. 2*c*–*d* illustrates certain additional Title Deed cards 82 for board locations 165, 167, 168, 170, 171, 173, 177, 179, 180, 183, 161, 162, on the add-on board 150. The Title Deed cards and board locations bear indicia marking the following common groups: 165, 167, 168; 170, 171, 173; 177, 179, 180; and 183, 161, 162.

FIG. 3*b* illustrates utilities Title Deed cards 92 for the utilities board locations 163, 175. These board locations become a common group with the utilities board locations 22, 38 on the existing Monopoly game board 1.

Figure 5:
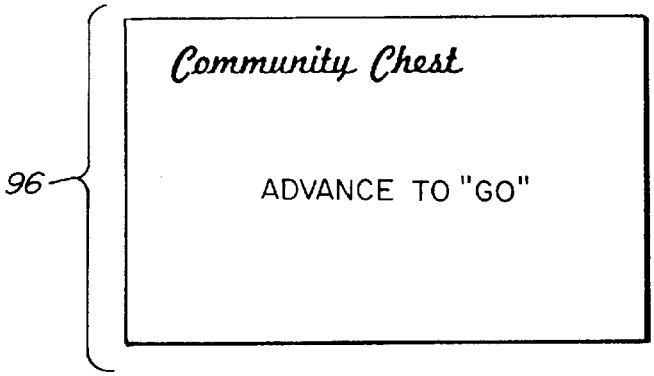
FIG. 5 illustrates a Community Chest card 96.
Figure 6:
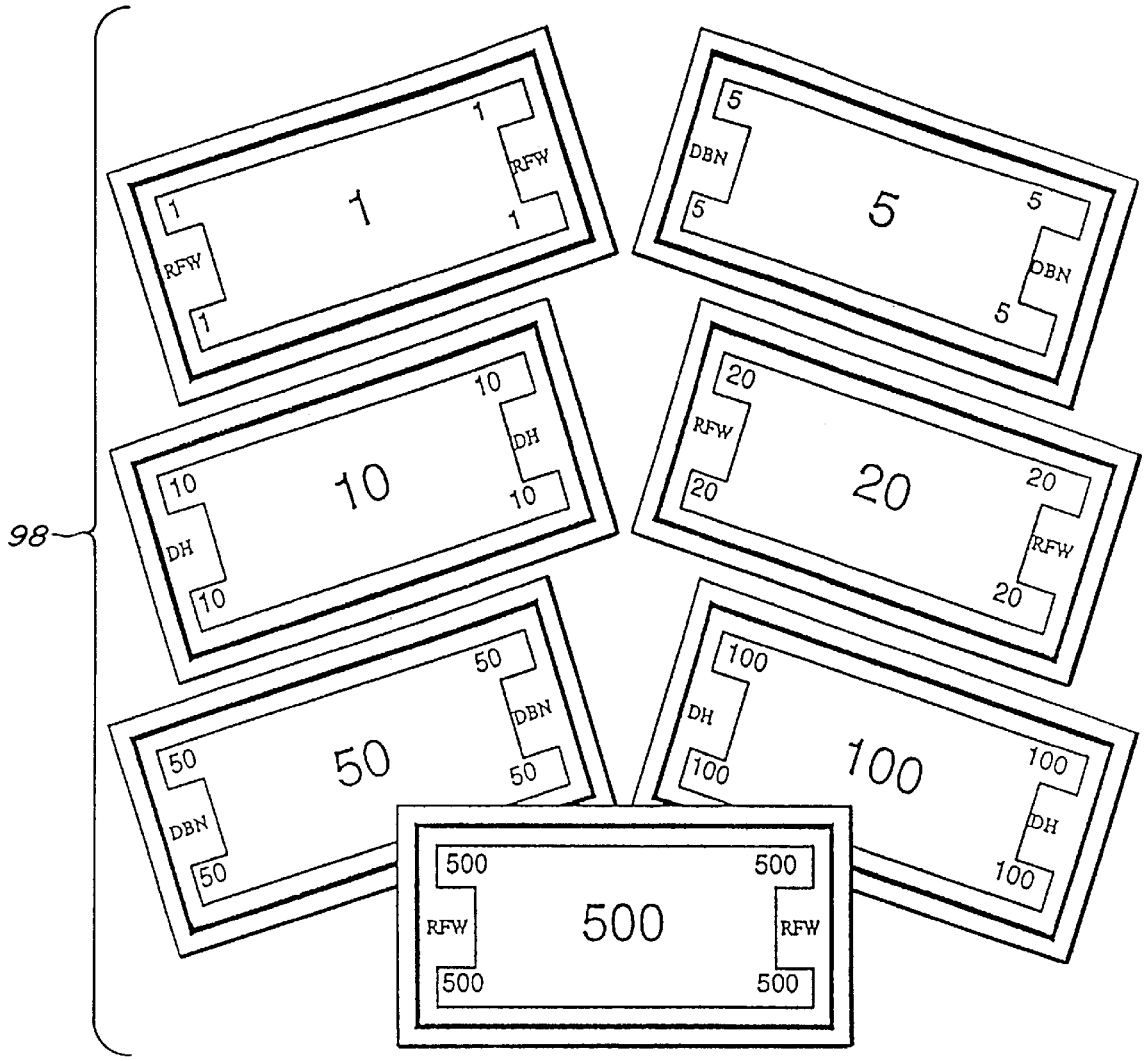
FIG. 6 illustrates money 98 for use in the invention.

In the preferred embodiment, the overall appearance of the additional Community Chest and Chance cards is the same as in the existing board game as shown in FIG. 4 and FIG. 5. The instructions for the additional Community Chest and Chance cards appear in Table 2.

TABLE 2

Additional Chance and Community Chest cards.

| | CHANCE CARDS | COMMUNITY CHEST CARDS |
|---|---|---|
| 1 | Take a ride in the Subway, If you pass GO or PASS collect $200 | Advance to PASS and Collect $200 |
| 2 | Advance to Boylston Street | Collect a Travel card |
| 3 | Advance to Triple Play and roll the dice | Win first price in Beauty context collect $25 |
| 4 | Advance to Lombard Street | Take half of any player's triple play winnings. This card may be kept until needed or sold. |
| 5 | Advance to Double Play | Your company goes public collect $200 |
| 6 | Pay $25 for each property owned unless mortgaged | If on inner board collect $200. If on outer board pay $25 to each player. |
| 7 | Land on Tax refund collect 100% from tax pool. This card may be kept until needed or sold. | Stock market crash lose $150 |
| 8 | Go forward 3 spaces | Invent new game collect $100 |

Figure 9:
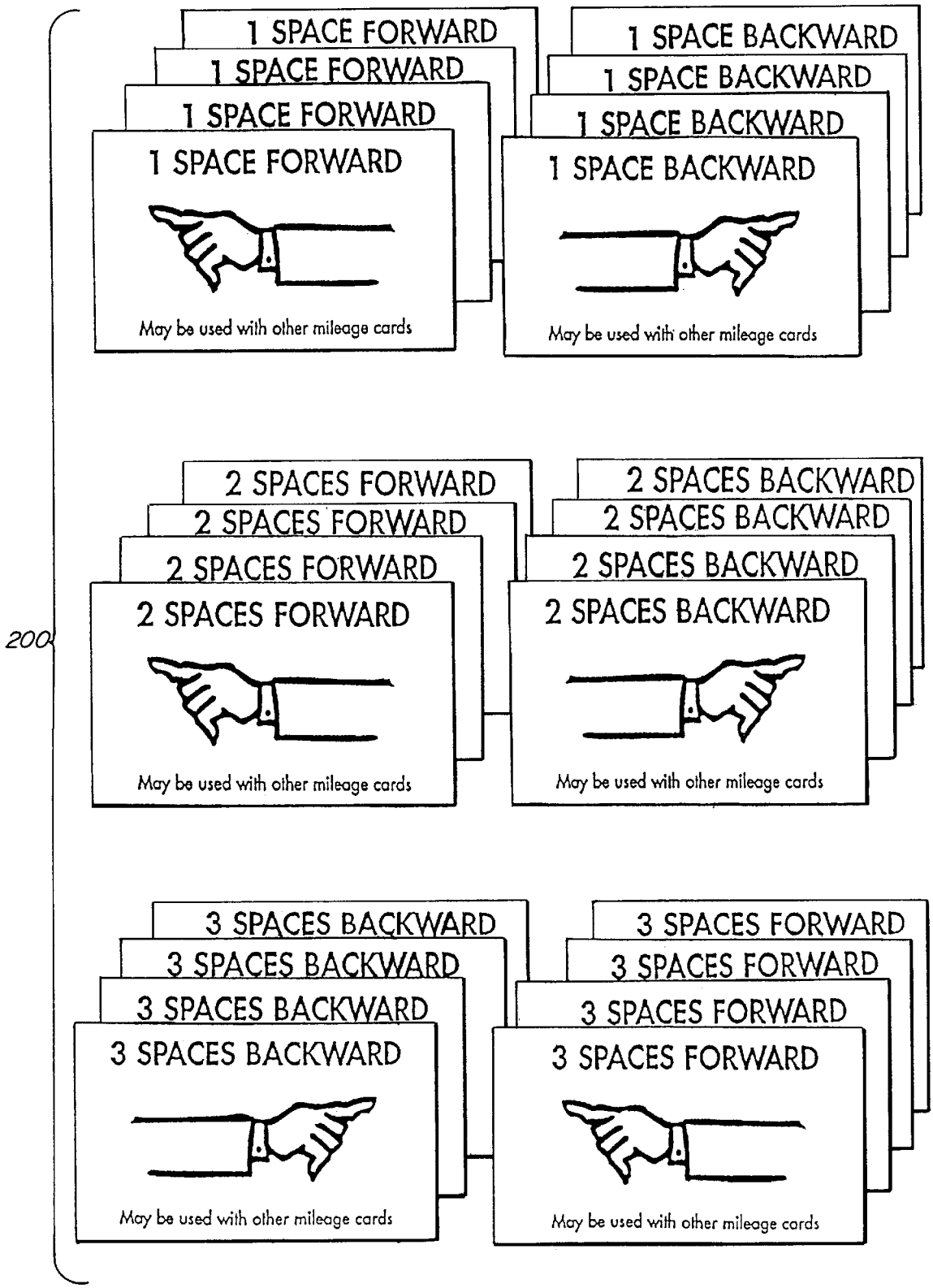
FIG. 9 illustrates travel cards 200.

FIG. 9 illustrates the travel cards 200 or the preferred embodiment.

Figure 10:
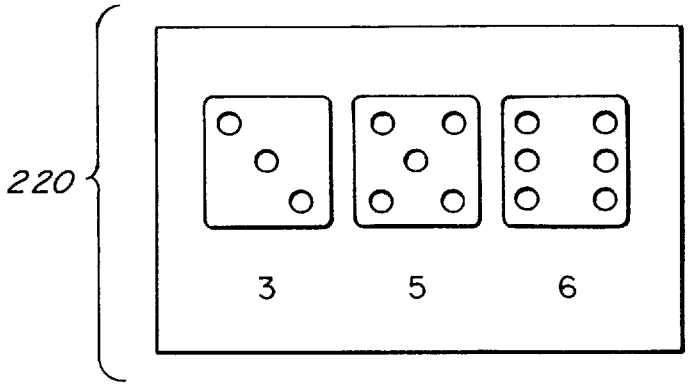
FIG. 10 illustrates a triple play card 220.

FIG. 10 illustrates a triple play card 220. The triple play numbers of the preferred embodiment appear in Table 3.

TABLE 3

Triple Play numbers.

| | | | | |
|---|---|---|---|---|
| 112 | 133 | 223 | 246 | 355 |
| 113 | 134 | 224 | 255 | 356 |
| 114 | 135 | 225 | 256 | 366 |
| 115 | 136 | 226 | 266 | 445 |
| 116 | 144 | 233 | 334 | 446 |
| 122 | 145 | 234 | 335 | 455 |
| 123 | 146 | 235 | 336 | 456 |
| 124 | 155 | 236 | 344 | 466 |
| 125 | 156 | 244 | 345 | 556 |
| 126 | 166 | 245 | 346 | 566 |

Preferably, the sets of travel cards 200, Community Chest cards 96, Chance cards 94, and triple play cards 220 are distinguishable in some way, such as by being formed of different colored material or having identifying indicia on the back of the card.

Figure 8:
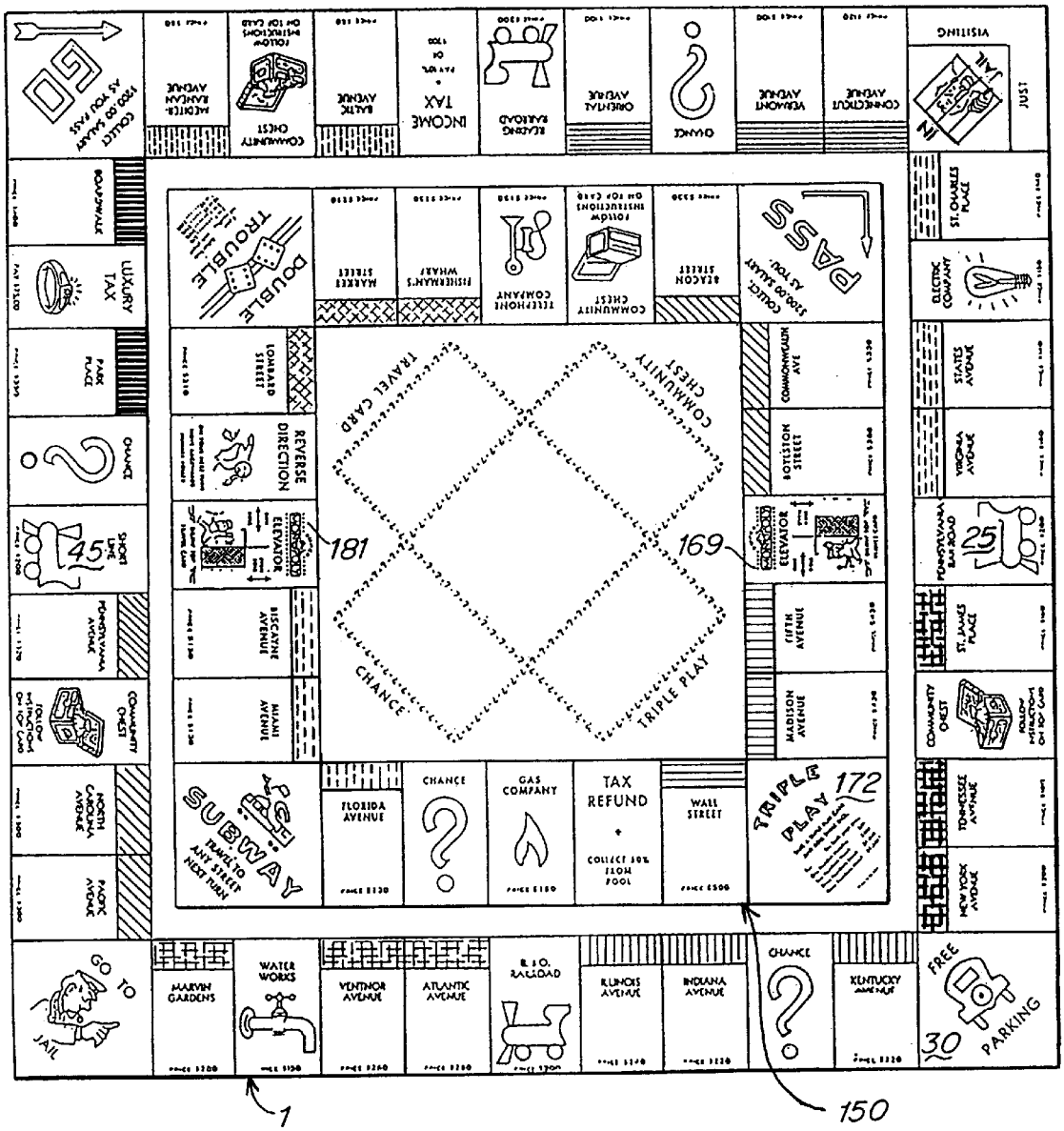
FIG. 8 illustrates an add-on board for Monopoly 150 positioned on a Monopoly board 1.

Before play begins, the add-on board 150 is positioned within the existing board game 1 as shown in FIG. 8. In the preferred embodiment, the triple play board location 172 is lined up against the Free Parking board location 30, as illustrated in FIG. 8, although other configurations are possible and within the scope of this invention. The additional Chance cards 94 and the additional Community Chest cards 96 are mixed with the respective original cards and placed in the center of the add-on board 150.

Before play begins and in the preferred embodiment, one of the travel cards 200 is provided to each player (face down) and one of the triple play cards 220 is provided to each player (face up). Provision of a different number of cards, or no cards, is possible. The remaining travel cards 200 and triple play cards 220 are placed in the center of the add-on board 150.

Play proceeds as in the existing board game, with each player beginning his or her first turn by placing a game piece 60 on the GO board location 10. Unlike the existing board game, in the preferred embodiment, all money 98 paid by a player due to Community Chest cards 96, Chance cards 94, luxury tax from landing on the luxury tax board location 48, income tax from landing on income tax board location 14, and penalties from getting out of the Jail board location 20, are placed in the center of the add-on board 150 rather than paid to the Bank. In an alternative embodiment, only money related to tax penalties from Community Chest cards 96, Chance cards 94, luxury tax and income tax go into the middle of the board.

In the preferred embodiment and as illustrated in FIG. 8, the existing game board 1 forms a circular path (i.e., a path through which a piece may continually be moved during play, unless the piece is moved to a different path). The add-on board 150 also forms a circular path. A player transitions from one board to the other as follows.

In the preferred embodiment, the add-on board 150 includes transition board locations 169, 181. When a player passes a transition board location 169, 181 or a location on the existing board adjacent to a transition board location 169 or 181 (i.e., locations 25, 45 on the configuration shown in FIG. 8), the player may transition between boards (in one embodiment, if a player lands on one of these board locations, the player does not "pass" that board location until the player's next turn).

In the preferred embodiment, the player transitions from one board to the other only if the total roll of the dice 75 is an even number. If the total roll is an odd number, the player continues moving the player's game piece along the board on which that game piece is already positioned.

In one embodiment, the transition board location is referred to as an "elevator" board location. A player's game piece "gets on the elevator" and changes boards on rolls having an even number of moves, but not an odd number.

In an alternative embodiment, the player transitions between boards 1, 150 if passing a transition board location 169, 181 or a location on the existing board adjacent to a transition board location 169 or 181, after an even number of steps, but not after an odd number of steps. For example, if a player rolls a 10 and starts moving his or her game piece on the board, if the third move of the 10 passes the transition point, the player would continue to move their piece game 60 on the same board. If four out of the Ten rolled had been the number that moved the game piece past the transition point, the piece would have continued forward on the same board finishing the count on that board, because four is an even number.

The preferred embodiment refers to indicia on the add-on board as the means for indicating transition board locations—for both the add-on board and the existing game board. A variety of other means are available for indicating transition board locations, such as arrows (affixed or not affixed to the boards), a string which can indicate transitions between board locations that are not adjacent to each other (by positioning ends of the string on the two board locations and transitioning from the board location at one end to the board location at other end), instructions for determining a transition board location, different indicia, and any other way of indicating a transition board location.

Figure 11:
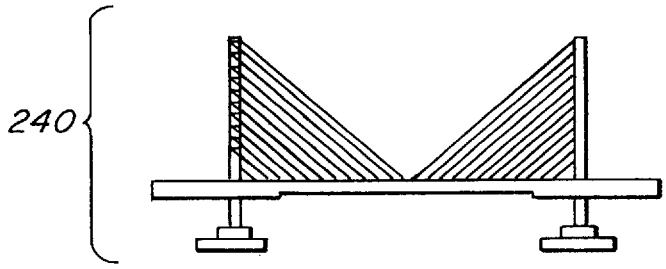
FIG. 11 illustrates a movable bridge 240.

FIG. 11 illustrates a movable bridge 240. In an alternative embodiment, players are provided with at least one bridge 240. Players may position the bridge 240 with one end of the bridge on a board location on the existing board 1 and the other end of the bridge on a board location on the add-on board 150. A player passing a board location that has one end of the bridge 240 on that board location may transition to the board location corresponding to the other end of the bridge 240 according to the techniques described above for board locations adjacent to the odd even, or elevator, board locations 169, 181. Optionally, the bridges may be moved during play according to a predetermined set of rules. Optionally, the bridge is adjustable to have different lengths or is made of a flexible material so that the bridge can mark transition board locations that are of varying distances apart. The bridge is another means for indicating board locations that allow a player to transition between boards. It should be understood that an object serving the above function is referred to as a bridge herein, no matter what the appearance of the object is.

Figure 12:
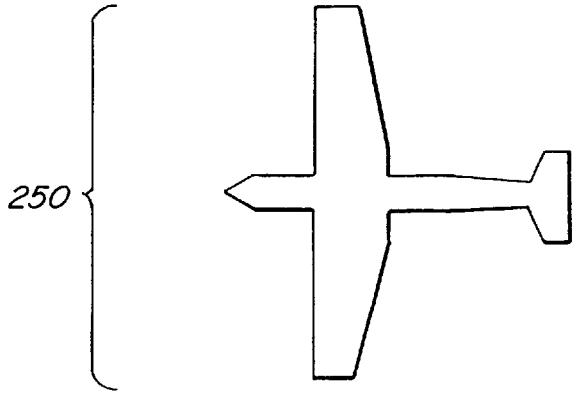
FIG. 12 illustrates a movable airplane 250.

FIG. 12 shows a movable airplane 250. In another embodiment, the players are provided with at least one airplane 250 that is positioned at a board location. A player that lands on a board location where the airplane 250 is located may "board" the airplane 250 and fly to any other board location on either board 1, 150 (leaving the airplane 250 on the destination board location on "exiting" the plane). Optionally, the player is required to pay an airplane fare which may vary depending on the destination board location. The airplane 250 is another means for indicating board locations that allow a player to transition between boards. It should be understood that any object serving the above function is referred to herein as an "airplane", no matter what the appearance of the object is.

When a player lands on the triple play board location 172, the player first draws a triple play card 220 from the pile. The player then rolls three dice to see if the player's, or another player's, triple play numbers match the dice rolled. The three dice are read in order from lowest to highest number. If any one of the rolled dice matches any one number of a player's triple play card 220, that player wins $50. If two of the rolled dice match numbers on a player's triple play card 220, that player wins $200 from the Bank. If all three rolled dice match the numbers on a player's triple play card 220, that player wins $1,000 from the Bank. If the player who rolled the dice rolled the number on his or her own triple play card 220, that player wins $1,500 from the Bank. In the preferred embodiment, players retain triple play cards 220 after a triple play roll. Players may have more than one triple play card 220 and a player collects a bonus for each triple play card that matches one or more number on the roll (alternatively, the player is required to pick a single triple play card from which to calculate the bonus).

For example, if the triple play dice rolled were 6, 3 and 1 and the players had the following numbers on triple play cards 220, the winnings would be as follows:

| | | | |
|---|---|---|---|
| Player 1 | 544 | No Numbers Match | $0. |
| Player 2 | 642 | One Number Matches | $50. |
| Player 3 | 431 | Two Numbers Match | $200. |
| Player 4 | 631 | Three Numbers Match | $1,000. |

If the player who landed on the triple play board location 172 had the 631 Triple play number, that player would win $1,500 from the Bank. In determining the bonus, the numbers rolled may be taken in any order. Triple play cards 220 may be bought, sold, or traded among players.

While the triple play board location 172 and cards 220 of the preferred embodiment have been described, it should be understood that "triple play board location" and "triple play cards" refer to any board location and cards (or other device) that serve substantially similar functions, independent of the appearance or label attached to such a board location and cards.

When a player lands on an odd even/elevator board location 169, 181, the player draws a travel card 200. The player keeps the card until the player decides to use it. A player may use a travel card 200 before the player rolls the dice 75 for the player's turn. The use of a travel card 200 counts as a player's turn. A player does not throw the dice when using a travel card. Instead, the player follows the instructions for travel that appear on the face of the travel card 200. More than one travel card 200 may be used by a player at a time, but the player only "lands" on the final location after using each travel card 200 that the player uses during the move. Travel cards 200 may be bought, sold or traded among players. Players using a backward travel card that takes them past GO 10 or PASS 166 do not collect the $200. The player would collect $200 on the next turn that takes the player's game piece 60 onto or past the GO 10 or PASS 166 board location. After a travel card 200 has been used, it is returned to the bottom of the travel card pile, face down.

In an alternative embodiment, players can use travel cards 200 in conjunction with the roll of the dice 75. For example, if a player rolled an eight and had a forward two card of the travel cards 200, the player could play the forward two card with the roll of eight, making the actual move a ten instead of an eight. In this situation, the total number of board locations traversed (including through use of a travel card) are used to determine whether a transition between boards 1, 150 must be made.

When a player lands on the double trouble board location 160, the player rolls two dice 75 to determine how much money the other players must pay the player landing on the double trouble board location 160. If the player rolls a total of 5, 6, 7, 8 or 9, the player collects $50 from each player. If the player rolls 2, 3, 10 or 11, the player collects $100 from each player. Rolls of 2 or 12 mean "Double Trouble" and the player collects $200 from each other player. In an alternative embodiment, if a player rolls doubles they receive $200 from every player—any other roll and the player collects nothing.

While the double trouble board location 160 of the preferred embodiment has been described, it should be understood that "double trouble board location" refers to any board location that serves substantially similar functions, independent of the appearance or label attached to such a board location.

A player who lands on the tax refund board location 174 collects 50% from the current pool of money that is located in the middle of the board 150 (paid by players due to Community Chest cards 96, Chance cards 94, luxury tax from landing on the luxury tax board location 48, income tax from landing on income tax board location 14, and getting out of Jail board location 20). In an alternative embodiment, a player who lands on the tax refund board location 174 collects some other percentage or all of the current pool of money placed in the middle of the board 150.

While the tax refund board location 174 of the preferred embodiment has been described, it should be understood that "refund board location" refers to any board location that serves substantially similar functions, independent of the appearance or label attached to such a board location.

When a player lands on the subway board location 178, the player may "catch a train" directly to any board location 10–49, 166–172 on the boards 1, 150. If a property board location is selected and not owned, the player may purchase it from the Bank. Since this is a direct route, there is no way to pass GO 10 or PASS 166 when moving the player's piece. Alternatively, a player may have to pay a predetermined fare in order to ride the train. The fare may vary depending on the destination.

While the subway board location 178 of the preferred embodiment has been described, it should be understood that "subway board location" refers to any board location that serves substantially similar functions, independent of the appearance or label (such as train, taxi or airport) attached to such a board location.

When a player lands on or passes the PASS board location 166, that player collects $200.

Two new utilities board locations are included in the preferred embodiment (telephone 163 and gas 175) and accompany the original utilities board locations (electric company 22 & water works 38), thus increasing the potential revenue a player can earn from the utilities board locations. The rent charged when the owner holds more than two utilities are listed on the telephone & gas Title Deed cards 300.

When a player lands on the move backwards board location 182, on the player's next roll of the dice under the normal rules (i.e., the player's next turn or subsequent roll after doubles), the player moves backwards the number rolled, rather than forward. The directions for the odd even/elevator board locations 169, 181 are followed just as if going forward. In the preferred embodiment, a travel card cannot be used from the move backwards board location 182. In an alternative embodiment, instead of moving backward when landing on board location 182, the add-on board is rotated 90 degrees. On the player's next turn, the player continues moving forward.

While the move backwards board location 182 of the preferred embodiment has been described, it should be understood that "move backwards board location" refers to any board location that serves substantially similar functions, independent of the appearance or label attached to such a board location.

It should be understood that the above rules and additional board locations can be used together or by themselves to keep games fun and exciting. It should also be understood that a myriad of variations on the above rules are readily apparent to one of skill in the art and are within the scope of the present invention. For example, the dollar values may be altered, the board locations changed, or different cards used.

While the invention has been disclosed in connection with the preferred embodiments shown and described in detail, various modifications and improvements thereon will become readily apparent to those skilled in the art. For example, the above disclosure includes use of dice for determining a random number. A variety of other means for determining a random number (such as an arrow on a spin wheel that has numbers on its base, drawing a number from a shuffled deck of cards and using a computer to generate a random number) are possible and within the scope of the present invention even if the specific structure of the means is not explicitly disclosed herein. Accordingly, the spirit and scope of the present invention is to be limited only by the following claims.

What is claimed is:

1. A method of playing a game, the method of playing comprising the steps of:

providing a first board having a plurality of first board locations defining a first closed loop path;

providing a second board having a plurality of second board locations defining a second path;

positioning a game piece for each player at a starting position; and alternating turns among each player, a turn comprising the steps of determining a random movement length, moving the game piece corresponding to the player taking the turn along the path on which the game piece was located at the start of the turn, transitioning from the first path to the second path when passing a first transition board location on the first path when satisfying a first condition based on a random factor, and continuing on the first path when passing the first transition board location when not satisfying the first condition.

2. The method of claim 1, wherein the transitioning step comprises the step of:

transitioning from the first path to the second path if the player is making a move meeting a predetermined condition selected from the group consisting of:

moves having an even number of steps and moves having an odd number of steps.

3. The method of claim 2, wherein the step of providing a first board comprises the step of providing a MONOPOLY game board.

4. The method of claim 1, wherein the transitioning step comprises the step of:

transitioning from the first path to the second path if the player is passing the first transition board location after a number of steps satisfying a predetermined condition selected from the group consisting of: an even number of steps and an odd number of steps.

5. The method of claim 4, wherein the step of providing a first board comprises the step of providing a MONOPOLY game board.

6. The method of claim 1, wherein the step of providing a first board comprises the step of providing a MONOPOLY game board.

7. The method of claim 6, wherein the transitioning step comprises a step of transitioning from the first path to the second path when passing one of a plurality of transition board locations on the first path when satisfying a condition based on a random factor.

8. The method of claim 1, wherein:

the step of providing the first board comprises the step of providing an existing game board defining a complete board game; and the step of providing the second board comprises the step of providing an add-on board designed for use with the existing game board.

9. The method of claim 8, wherein the transitioning step comprises a step of transitioning from the first path to the second path when passing one of a plurality of transition board locations on the first path when satisfying a condition based on a random factor.

10. The method of claim 1, further comprising a step of identifying the first transition board location using indicia on the second board.

11. The method of claim 1, wherein the transitioning step comprises a step of transitioning from the first path to the second path when passing one of a plurality of transition board locations on the first path when satisfying a condition based on a random factor.

12. The method of claim 1, further comprising a step of identifying the first transition board location using a movable piece.

13. The method of claim 1, further comprising a step of changing the location of the first transition board location.

14.The method of claim 13, wherein the random factor is the location of the first transition board location.

15. The method of claim 1, wherein the second path is a closed loop path and the turn further comprises steps of:

transitioning from the second path to the first path when passing a second transition board location on the second path when satisfying a second condition based on a random factor; and continuing on the second path when passing the second transition board location when not satisfying the second condition.

16. The method of claim 15, wherein the transitioning step comprises a step of transitioning from the first path to the second path when passing one of a plurality of transition board locations on the first path when satisfying a condition based on a random factor.

17. The method of claim 15, further comprising a step of identifying the first transition board location and the second transition board location using a movable piece.

18. The method of claim 15, wherein:

the step of providing the first board comprises the step of providing an existing game board defining a complete board game; and the step of providing the second board comprises the step of providing an add-on board designed for use with the existing game board.

19. The method of claim 18, wherein the step of providing the first board comprises the step of providing a MONOPOLY game board.

20. The method of claim 15, wherein the first condition and the second condition are the same.

* * * * *